US007715774B2

(12) United States Patent
Ueno

(10) Patent No.: US 7,715,774 B2
(45) Date of Patent: May 11, 2010

(54) IMAGE FORMING APPARATUS WHICH CONTROLS HEATING WIDTH OF FIXING DEVICE

(75) Inventor: Satoshi Ueno, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 469 days.

(21) Appl. No.: 11/679,524

(22) Filed: Feb. 27, 2007

(65) Prior Publication Data

US 2007/0201916 A1 Aug. 30, 2007

(30) Foreign Application Priority Data

Feb. 27, 2006 (JP) ..... 2006-050212

(51) Int. Cl.
*G03G 15/20* (2006.01)

(52) U.S. Cl. ..... 399/334; 399/69

(58) Field of Classification Search ..... 399/16, 399/43, 45, 67, 69, 329, 334; 219/216, 619
See application file for complete search history.

(56) References Cited

U.S. PATENT DOCUMENTS 6,038,424 A * 3/2000 Nakagawa ..... 399/367
2002/0031380 A1* 3/2002 Sato ..... 399/328
2004/0028420 A1* 2/2004 Aslam et al. ..... 399/45
2004/0190927 A1* 9/2004 Tsukamoto et al. ..... 399/82
2005/0191098 A1 9/2005 Ueno et al.
2006/0029411 A1 2/2006 Ishii et al.

FOREIGN PATENT DOCUMENTS

JP 09-218601 8/1997
JP 2005-258383 9/2005

* cited by examiner

*Primary Examiner*—David P Porta
*Assistant Examiner*—Milton Gonzalez
(74) *Attorney, Agent, or Firm*—Oblon, Spivak, McClelland, Maier & Neustadt, L.L.P.

(57) ABSTRACT

A fixing device includes a fixing section, a sheet-width detector, a heating-width changing mechanism, a mixed feeding detector, and a controller. The fixing section includes at least a fixing member that fixes a toner image on a recording medium upon application of heat thereto. The sheet-width detector detects a width of the recording medium and outputs a sheet-width signal. The heat-width changing mechanism changes a heating width of the fixing member. The mixed feeding detector detects whether or not mixed feeding of a plurality of sheets of the recording medium having different widths is performed during a successive sheet feeding, and outputs a mixed feeding signal. The controller controls the heating-width changing mechanism to control the heating width based on the sheet-width signal and the mixed feeding signal.

11 Claims, 8 Drawing Sheets

IMAGE FORMING APPARATUS WHICH CONTROLS HEATING WIDTH OF FIXING DEVICE

CROSS-REFERENCE TO RELATED APPLICATION

This patent application is based on Japanese patent application, No. 2006-050212 filed on Feb. 27, 2006 in the Japan Patent Office, the entire contents of which are incorporated by reference herein.

BACKGROUND OF INVENTION

1. Field of the Invention

Exemplary aspects of the present invention relate to an image forming apparatus, and more particularly to an image forming apparatus and the changing of the heating width of its fixing device.

2. Description of the Related Art

In general, image forming apparatus of recent years such as copiers, printers, facsimile machines, and multifunctional peripherals employ an electro-photographic method to form a toner image on an image carrier by a series of image forming processes such as charging, writing, developing, transferring, cleaning, and discharging. The toner image on the image carrier is transferred on a recording medium such as transfer paper and overhead projector films. The image forming apparatus includes a fixing device in which heat and pressure are applied by a fixing member and a pressure member to fix the toner image on the transfer medium.

Such image forming apparatuses are demanded to shorten a warm-up time when power is initially turned on. The fixing member of the fixing device increases the temperature thereof to a suitable level during warm-up so that the image forming apparatus can become operatable.

In attempting to shorten the warm-up time, fixing devices having a fixing member with a relatively low heat capacity have been developed and practically used. Specific examples thereof include a fixing device in which a nip is formed between a rotation member and a fixing film that has a relatively low heat capacity and faces the rotation member. Another example is a fixing device that employs a fixing belt as the fixing member, wherein and the fixing belt is tightly stretched by a plurality of rotation members. One of the plurality of rotation members has a relatively low heat conduction and forms a fixing nip with the a rotation member while another of the plurality of rotation members includes a heat source such as heaters. Recently, induction heating systems in which a fixing member having a relatively low heat capacity is directly heated have been used as the heat source as well as heaters. The fixing devices with the induction heating system have an advantage such that the fixing member having a relatively low heat capacity can increase the temperature thereof in a relatively short time period, resulting in shortening of the warm-up time of the fixing device. One example attempts to shorten the warm-up time by applying a relatively large amount of heat to the fixing belt in a short time period. The fixing device includes a contact member which presses the fixing belt so that the fixing belt and a heating roller having a heat source therein have a large contact length. Thereby, a relatively large amount of heat is applied to the fixing belt in a short time period.

According to another example of an attempt to reduce fixing errors when a variety of recording media having different widths are used, an increase in temperature at both ends of the fixing member in a width direction is controlled even when a plurality of recording media having small widths are successively fixed. In addition, the fixing device includes an induction heating unit including a shielding member for shielding and a core. The shielding member varies the heating area in a width direction of the fixing member by shielding a part in a width direction of the core when an electric current is applied to a coil of the induction heating unit. The core includes a protrusion member at the end in the width direction thereof. The protrusion member protrudes towards the coil of the induction heating.

Therefore, the related art fixing device attempts to reduce the increase in temperature of the fixing member at a non-sheet feeding area, by controlling the width of the heated portion of the fixing member when a recoding medium having a relatively small width is fed.

However, when the width of the recording medium is frequently switched for one printing operation, the control of the heating width is late due to the response speed of the mechanical operation or the response speed by the heat capacity of the fixing member. Thereby, the heating width is not properly controlled. When a related art heat fixing device with a low-speed and low-heat amount and a high-speed and high-heat amount is used, the temperature of a non-sheet feeding area cannot reach a risk range immediately because the control of the heating width is late.

SUMMARY OF THE INVENTION

According to an aspect of the invention, an image forming device includes a fixing section, a sheet-width detector, a heating-width changing mechanism, a mixed feeding detector, and a controller. The fixing section includes at least a fixing member that fixes a toner image on a recording medium upon application of heat thereto. The sheet-width detector detects a width of the recording medium and outputs a sheet-width signal. The heat-width changing mechanism changes a heating width of the fixing member. The mixed feeding detector detects whether or not mixed feeding of a plurality of sheets of the recording medium having different widths is performed during a successive sheet feeding, and outputs a mixed feeding signal. The controller controls the heating-width changing mechanism to control the heating width based on the sheet-width signal and the mixed feeding signal.

An image forming apparatus includes an image bearing member, a transfer device and the fixing device. The image bearing member bears a toner image thereon. The transfer device transfers the toner image onto a recording medium.

BRIEF DESCRIPTION OF THE DRAWINGS

A more complete appreciation of the exemplary aspects of the invention and many of the attendant advantage thereof will be readily obtained as the same becomes better understood by reference to the following detailed description when considered in connection with the accompanying drawings, wherein.

DETAILED DESCRIPTION OF EXEMPLARY EMBODIMENTS

Figure 1:
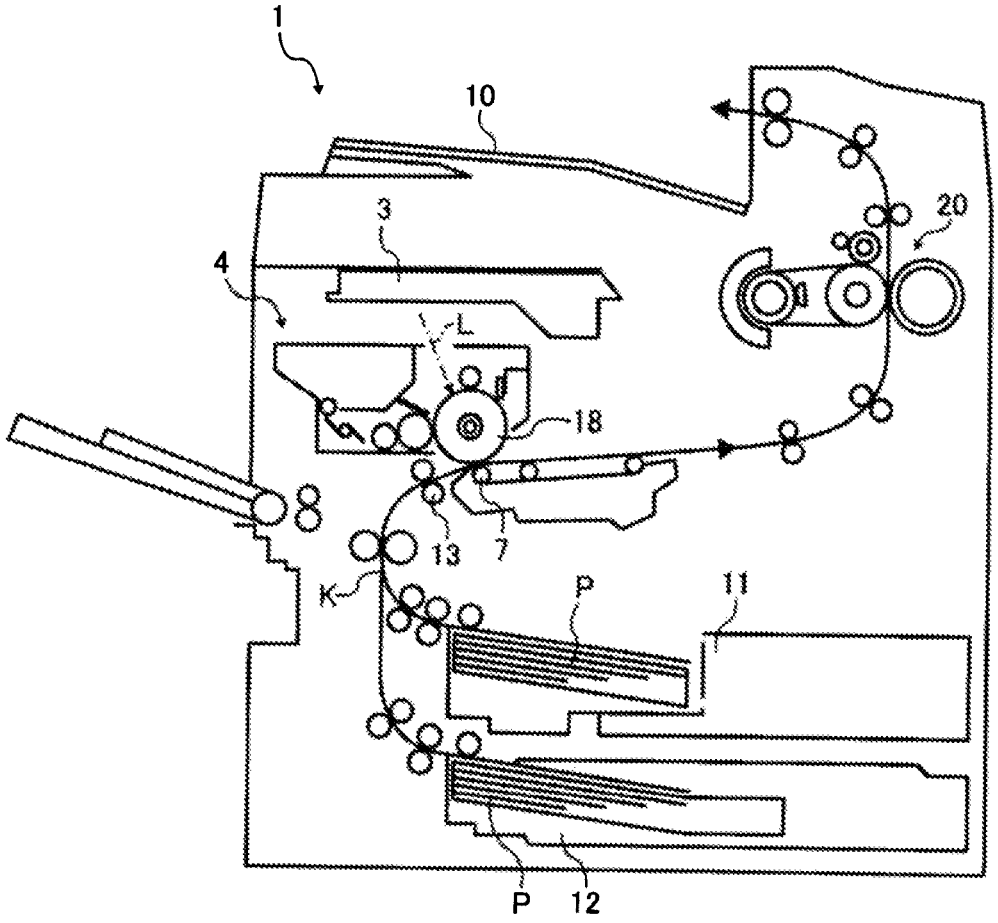
FIG. 1 is a schematic cross section illustrating an image forming apparatus according to an exemplary embodiment of the present invention.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, an image forming apparatus 1 according to an exemplary embodiment of the present invention is described.

Referring to FIG. 1, the image forming apparatus 1 includes an exposure unit 3, a fixing device 20, a transfer unit 7, a pair of registration rollers 13, a plurality of sheet feeding units such as a first sheet feeding unit 11 and a second sheet feeding unit 12, an ejection tray 10, and a process cartridge 4. The process cartridge includes a photoconductor drum 18. The exposure unit 3 emits light L, for example, a laser beam, based on image information. The fixing device 20 fixes a toner image transferred onto a recording medium P. The transfer unit 7 transfers the toner image on the photoconductor drum onto the recording medium P. The registration rollers 13 convey and register the recording medium P. The first sheet feeding unit 11 stores the recording medium P. The second sheet feeding unit 12 stores the recording medium P. The ejection tray 10 is a tray on which the recording medium is ejected. The process cartridge 4 includes the photoconductor 18 and at least one of image forming elements such as charging devices, cleaning devices, and development devices. The photoconductor drum 18 forms an electrostatic latent image thereon by the light L emitted from the exposure unit 3.

According to the exemplary embodiment of the present invention, the exposure unit 3 emits the light L towards the photoconductor drum 18 of the process cartridge 4. The photoconductor drum 18 rotates counterclockwise, and forms the toner image thereon by a series of image forming processes such as charging, exposing, and developing. The toner image includes the image information. The transfer unit 7 transfers the toner image from the photoconductor drum 18 onto the recording medium P which is conveyed by the registration rollers 13.

When the recording medium P is conveyed to the transfer unit 7, one of the plurality of sheet feeding units included in the image forming apparatus 1 is automatically or manually selected.

Each of the plurality of sheet feeding units, for example, the sheet feeding units 11 and 12, stores certain size sheets of the recording medium P. In this way, the plurality of sheet feeding units stores different size sheets of the recording medium P.

An uppermost sheet of the recording medium P in the first sheet feeding unit 11 is conveyed towards a conveyance path K, and reaches the position of the registration roller 13. The registration rollers 13 register the recording medium P at a desired time and convey the recording medium P to the transfer unit 7 so that a toner image on the photoconductor 18 is transferred onto a predetermining portion of the recording medium P.

Figure 2:
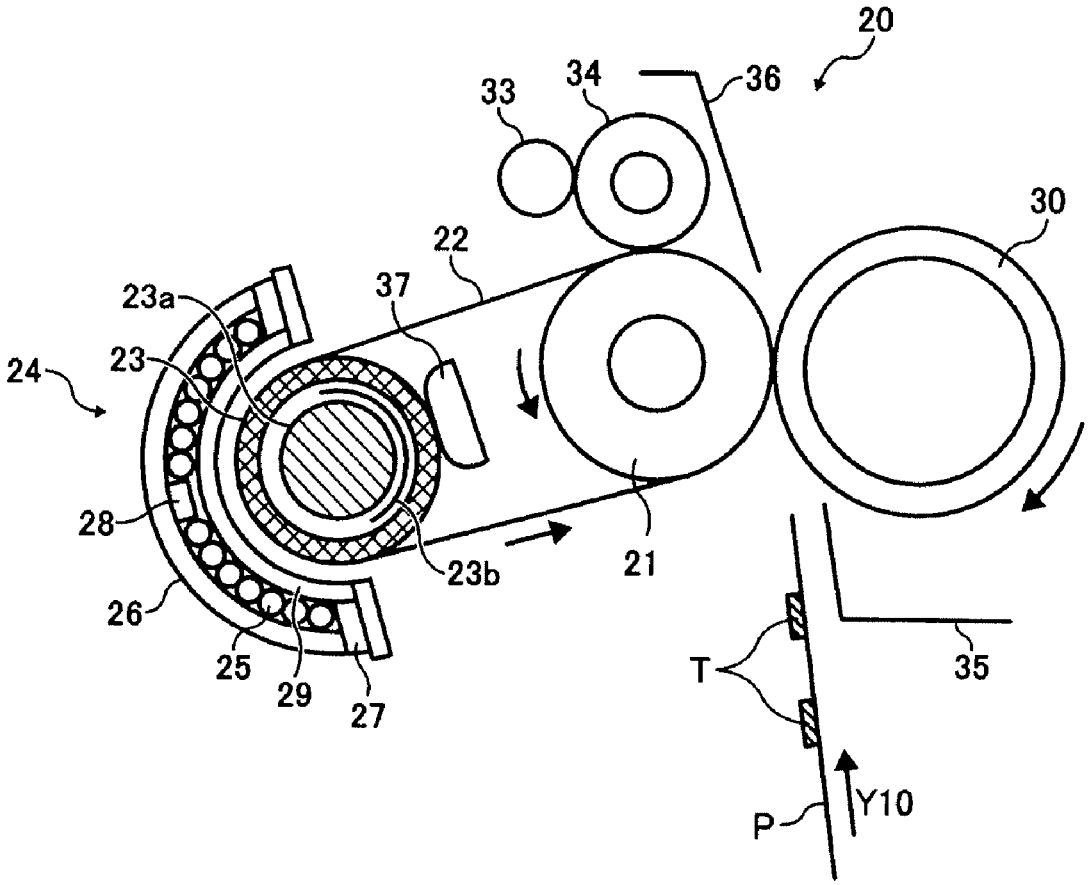
FIG. 2 is a schematic cross section illustrating a fixing device for use in the image forming apparatus of FIG. 1.

When the transfer unit 7 transfers the toner image from the photoconductor 18 onto the recording medium P, the recording medium P is conveyed to the fixing device 20 that includes a fixing belt 22 (shown in FIG. 2) and a pressure roller 30 (shown in FIG. 2). The recording medium P is fed into a nip between the fixing belt 22 and the pressure roller 30 so that the toner image on the recording medium P is fixed by heat and pressure applied by the fixing belt 22 and the pressure roller 30. When the toner image on the recording medium is fixed, the recording medium P is fed out from the nip between the fixing belt 22 and the pressure roller 30. The recording medium P with a fixed toner image is ejected from the image forming apparatus 1 as an output image, and is stacked on the ejection tray 10. Thus, the series of image forming processes are completed.

Referring to FIG. 2, the fixing device 20 included in the image forming apparatus 1 of FIG. 1 according to the exemplary embodiment of the present invention is illustrated in a schematic cross section. The fixing device 20 includes a fixing roller 21, the fixing belt 22, a heating roller 23, an induction heating unit 24, the pressure roller 30, a thermostat 37, an oil applying roller 34, a guide plate 35, and a separation plate 36. The heating roller 23 includes an internal core 23*a* and shielding members 23*b* therein. The induction heating unit 24 includes a coil 25, a core 26, a side core 27, a center core 28, and a coil guide 29. The oil applying roller 34 includes a cleaning roller 33 in a vicinity thereof.

The fixing roller 21 has an elastic layer on a surface thereof. The elastic layer may be silicon rubber, for example. The fixing roller 21 is rotationally driven by a driving unit (not shown) in a counterclockwise direction in FIG. 2. The heating roller 23 serving as a heating member is a non-magnetic cylindrical member, and rotates counterclockwise in FIG. 2. The heating roller 23 includes a non-magnetic material such as SUS304 (a stainless steel defined by Japanese Industrial Standard). The internal core 23*a* includes a ferromagnetic material such as ferrite, and the shielding members 23*b* includes a low magnetic permeability material such as copper. The internal core 23*a* is opposed to the coil 25 with the fixing belt 22 therebetween.

The shielding members 23*b* are configured to shield both ends of the internal core 23*a* in the width direction. The internal core 23*a* and the shielding members 23*b* are configured to rotate integrally. The internal core 23*a* and the shielding members 23*b* are rotated independently of the heating roller 23.

The fixing belt 22 serving as a fixing member is tightly stretched by the heating roller 23 and the fixing roller 21. The fixing belt 22 is a multilayer endless belt. For example, the endless belt includes a base layer including a polyimide resin, a heat generation layer including a material such as silver, nickel, and iron, and a releasing layer serving as an outmost layer including a fluorine compound. The releasing layer of the fixing belt 22 allows a toner image T on the fixing belt 22 to be released from the fixing belt 22.

The coil 25 included in the induction heating unit 24 is a litz wire that has a bundle of fine lines. The litz wire of the coil 25 extends in the width direction of the core (i.e., in the vertical direction perpendicular to the surface of a paper sheet on which FIG. 2 is printed) so as to cover a part of the fixing belt 22 winding around the heating roller 23. The coil guide 29 of the induction heating unit 24 includes a heat-resistant resin material, and holds the coil 25, the core 26, the side core 27, and center core 28. Each of the core 26, the side core 27, and center core 28 includes a high magnetic permeability material such as ferrite. The core 26 is opposed to the coil 25. The side core 27 is disposed at an end of the coil 25. The center core 28 is disposed at a center of the coil 25.

The fixing device 20 includes a core unit. This core unit includes the core 26, the side core 27, the center core 28, and the internal core 23*a*, and contributes to electromagnetic induction heating. Since the heating roller 23 includes the internal core 23*a* therein, a proper magnetic field can be formed between the core 26 and the internal core 23*a*. Thereby, the heating roller 23 and the fixing belt 22 can be heated efficiently.

The pressure roller 30 includes a metal core on which there is an elastic layer made of a material such as a fluorine rubber or a silicon rubber. This pressure roller 30 is pressure-contacted with the fixing roller 21 with the fixing belt 22 therebetween. The recording medium P is conveyed to a contact area (referred to as a fixing nip) formed between the fixing belt 22 and the pressure roller 30.

The guide plate 35 guides the recording medium P. This guide plate 35 is disposed at an inlet side of the fixing nip formed between the fixing belt 22 and the pressure roller 30. The separation plate 36 is disposed at an outlet side of the fixing nip. This separation plate 36 guides the recording medium P while separating the recording medium P from the fixing belt 22.

The oil applying roller 34 contacts a portion of an outer circumference surface of the fixing belt 22. The oil applying roller 34 applies an oil such as silicon oils, on the fixing belt 22 to impart toner releasability to the toner image T on the fixing belt 22. The oil applying roller 34 contacts the cleaning roller 33 that cleans the surface of the oil applying roller 34.

The thermostat 37 contacts an outer circumference surface of the heating roller 23. The thermostat 37 detects the temperature of the heating roller 23. When the temperature of the heating roller 23 is higher than the predetermined temperature, the thermostat 37 shuts off the power to the induction heating unit 24. A thermistor (not shown) serving as a temperature detection mechanism is disposed on the fixing belt 22. The thermistor directly detects the temperature (referred to as fixing temperature) of the surface of the fixing belt 22 to control the fixing temperature. The fixing belt 22 may employ a thermopile as the temperature detection mechanism that detects the temperature of fixing belt 22 without being contacted therewith, although any suitable temperature detection mechanism may be used.

The fixing device 20 operates as follows. The fixing belt 22 is rotated in a direction, indicated by an arrow shown in FIG. 2, by the fixing roller 21 while the heating roller 23 rotates counterclockwise, and the pressure roller 30 rotates in a direction indicated by an arrow. The surface of the fixing belt 22 is heated at a position substantially opposed to the induction heating unit 24. When the coil 25 is applied with a high frequency alternating current, magnetic lines of force are formed between the core 26 and the internal core 23*a* which alternate direction. In this case, an eddy current is formed on a surface of the heating roller 23, thereby, generating Joule heat therein due to the electric resistance thereof. The fixing belt 22 which is wrapped around the heating roller 23 is heated by the Joule heat.

The surface of fixing belt 22 heated by the induction heating unit 24 reaches the nip between the fixing belt 22 and the pressure roller 30, and the toner image T on the recording medium P is heated and fused. For example, the recording medium P on which the toner image T is formed by the series of image forming processes is guided by the guide plate 35, and is fed into the nip between the fixing belt 22 and the pressure roller 30 as indicated by an arrow Y10 in FIG. 2. The toner image T on the recording medium P is fixed by the heat and pressure applied by the fixing belt 22 and the pressure roller 30, and is fed out from the nip between the fixing belt 22 and the pressure roller 30.

Figure 3A:
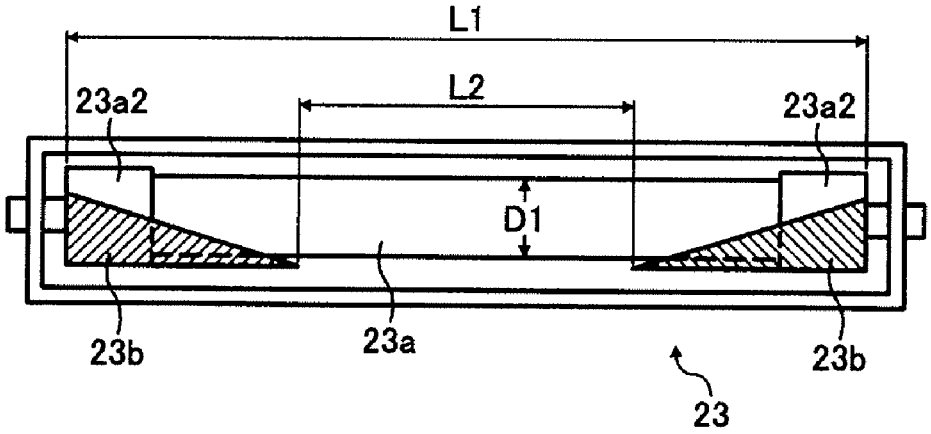
FIGS. 3A and 3B are schematic front elevations illustrating a heating roller for use in the fixing device of FIG. 2 when observed from the induction heating unit side.
Figure 3B:
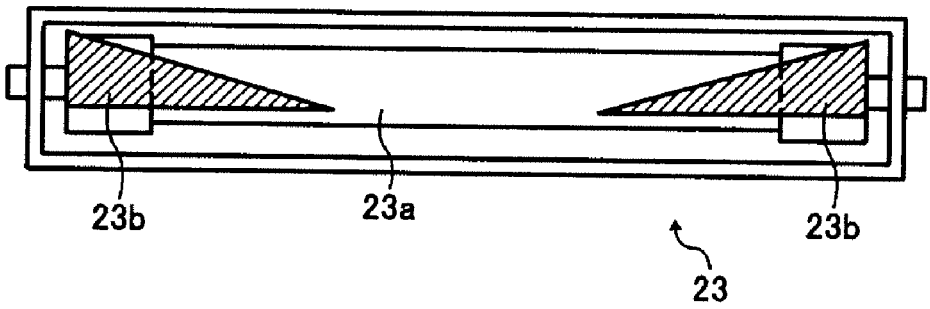

Referring to FIG. 3A and FIG. 3B, the heating roller 23 for use in the fixing device 20 is illustrated in schematic front elevations when observed from the induction heating unit 24. The heating roller 23 is a cylindrical member, and includes the internal core 23*a* and the shielding members 23*b* therein. The internal core 23*a* is a column having a width L1 and a diameter D1. The internal core 23*a* and the shielding members 23*b* are rotatably provided in the heating roller 23.

The shielding members 23*b* are integrally disposed at both ends of the internal core 23*a* in the width direction. The shielding members 23 have such a shape as to increase or decrease the area of the shielded circumference surface of the internal core 23*a* toward the end of the internal core 23*a*. By rotating, the internal core 23*a* with the shielding members 23*b*, the shielding area in the width direction of the internal core 23*a* opposed to the coil 25 in the induction heating unit 24 can be varied.

Figure 4:
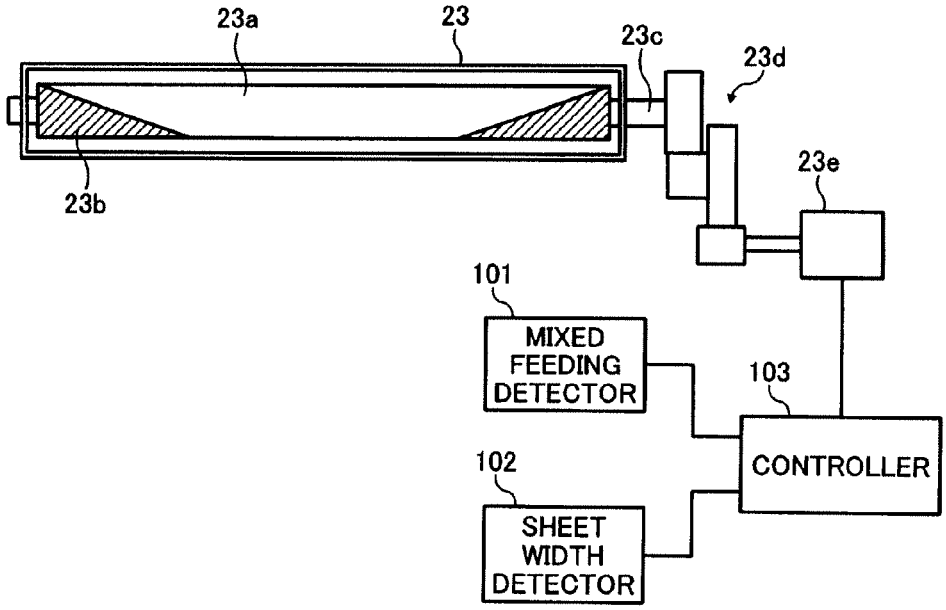
FIG. 4 is a schematic diagram illustrating a driving system for driving the heating roller of the fixing device of FIG. 2.

Referring to FIG. 4, the heating roller 23 of the fixing device 20 includes a stepping motor 23*e* that is configured to drive the heating roller 23*b*. As shown in FIG. 4, a shaft 23*c* is connected to the internal core 23*a*, and can be rotated by the stepping motor 23*e* through gears 23*d*. Therefore, the area of the shielded portion of the internal core 23*a* opposed to the coil 25 can be varied. The stepping motor 23*e* is a driving system, and is separated from another driving system (not shown) configured to drive elements such as the fixing roller 21, the fixing belt 22, and the heating roller 23.

For example, when the internal core 23*a* and the shielding member 23*b* in the state of FIG. 3A are rotated by 90 degrees in the circumference direction thereof, the internal core 23*a* and the shielding member 23*b* achieve the state of FIG. 3B. In this state, the area of the shielded portion of the internal core 23*a* opposed to the induction heating unit 24 is increased by the shielding members 23*b*. The magnetic lines of force to be formed between the induction heating unit 24 and the core 26 are shielded by the shielded portion. Thereby, the portion of the fixing belt 22 corresponding to the shielded portion is hardly heated. However, another portion of the fixing belt 22, for example, the portion having a width L2 in FIG. 3A, can be heated.

This state in which the heated portion of the fixing belt 22 has the width L2 is suitable for successively feeding toner images on a plurality of sheets of the recording media P with the width L2. When the recording medium P with a minimum width (for example, 148 mm) is fixed, the position of the internal core 23*a* and the shielding member 23*b* is preferably fixed in the state of FIG. 3B so as to fix the toner image on the recording media P.

When the internal core 23*a* and the shielding member 23*b* in the state of FIG. 3B are further rotated by 180 degree in the circumference direction thereof, the portion of the internal core 23*a* opposed to the induction heating unit 24 is not shielded by the shielding members 23*b*. In this case, the magnetic lines of force are formed between the opened internal core 23*a* and the core 26 in the induction heating unit 24, and thereby the entire surface of the fixing belt 22 in the width direction thereof (i.e., the portion with width L1 in FIG. 3A) is heated.

This state in which the heated portion of the fixing belt 22 has the width L1 is suitable for successively feeding the toner images on a plurality of sheets of the recording media P with the width L1. When the recording medium P with a maximum width (for example, 297 mm) is fixed, the position of the internal core 23*a* and the shielding member 23*b* is rotated by 180 degree from the state of FIG. 3B and is preferably fixed so as to fix the toner image on the recording media P.

When sheets of the recording medium P that have a width larger than L2 and smaller than L1 is fixed, the internal core 23*a* and the shielding members 23*b* are rotated to a proper angle depending on the width of recording medium P so that the heating range of the fixing belt 22 is suitable for the width of the recording medium P. Thereby, the temperature distribution in the width direction of the fixing belt 22 is adjusted so as to be suitable for the sheets width range of the recording medium P, resulting in a production of fixed images having good fixing property. In this case, the temperature of the potions of the fixing belt 22 outside the width range of the recording medium P hardly increases, resulting in a reduction of risk of damaging the fixing belt 22.

According to the exemplary embodiment of the present invention, the heating range in the width direction of the fixing belt 22 is varied by employing the shielding members 23*b* shielding a portion of the internal core 23*a*. In addition, the internal core 23*a* has a large diameter portion 23*a*2 at the end thereof, and therefore a distance between the coil 25 and the ends of internal core 23*a* becomes shorter than that at the a middle portion in the width direction by having large diameter portion 23*a*2 at the both ends in the width direction of the internal core 23*a*. Therefore, when toner images on a plurality of sheets of the recording media P with a small width are successively fixed, the likelihood of an increase in the temperature at both ends in the width direction of the fixing belt 22 can be reduced, and the likelihood of poor fixing can be decreased even when the recording media P having various widths are used.

Figure 5:
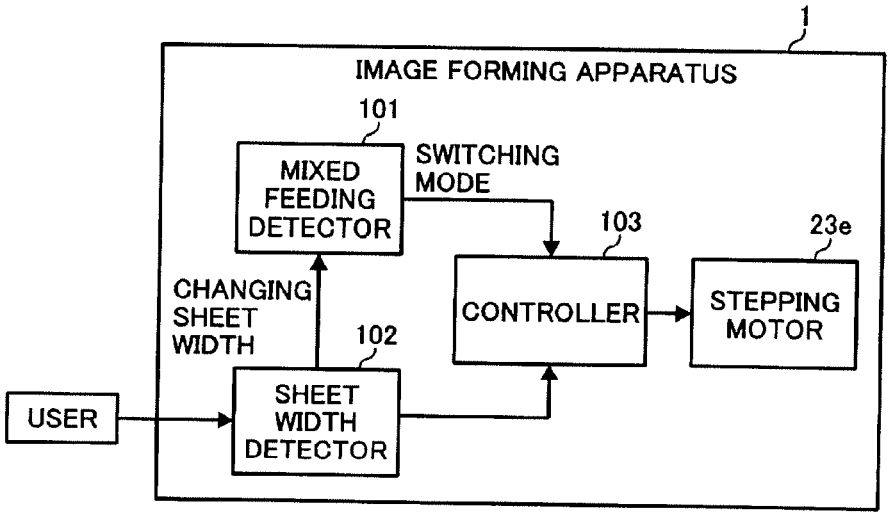
FIG. 5 is a schematic block diagram illustrating a control system for controlling the fixing device in the image forming apparatus of FIG. 1.

Referring to FIG. 5, a control system for controlling the fixing device 20 in the image forming apparatus 1 of FIG. 1 is illustrated in a schematic block diagram. As shown in FIG. 5, the image forming apparatus 1 of the exemplary embodiment of the present invention includes a mixed sheet feeding detector 101, a sheet-width detector 102, a controller 103, and the stepping motor 23*e*. The mixed sheet feeding detector 101 detects mixed feeding of a plurality of sheets of the recording medium P with different widths during a successive sheet feeding, and outputs a mixed feeding signal. The sheet-width detector 102 detects widths of sheets of the recording medium P, and outputs a sheet-width signal.

According to one embodiment of the invention, the sheet width detector 102 is implemented in software and may be part of the image forming apparatus. Take for example a situation where the image forming apparatus is a printer connected to one or more computing devices. In such a case, a user selects or specifies a size of recording sheets used within a printing job, and commands or information provided to selector indicate the size of the recording sheet. According to one embodiment, the recording sheet is specified through the use of a printer driver within a computer which sends a printing job. According to another embodiment, the user can select the recording size using an operation panel on a copier or MFP (multi-function printer). Further, a facsimile machine or any other image forming apparatus may use different size sheets and information on the size of the recording sheets can be detected or determined, as desired. In addition to the sheet width the detector 102 operating based on a detection of printer commands, printer control language, or by other means in which the size of the recording sheets are specified, the sheet width detector alternatively can be implemented using sensors, such as optical, or mechanical sensors, which detect the physical size of the paper. The sheet width detector indicates the size of the recording sheet to the controller 103 and/or the mixed feeding detector 101. When a user or a plurality of users select or specify different sizes of recording sheets within printing jobs, the sheet width detector 102 detects the width of the selected or specified recording sheet and the mixed feeding detector 101, through the use of a controller, programmed controller, or other controlling device, detects that the widths of the recording sheets are changed. For example, the system may determine, detect, or otherwise realize that a recording sheet of size A4 is being conveyed in a vertical direction (portrait), and the next selected sheet is still A4 size but is being conveyed in a horizontal (landscape) direction. In such a case, the mixed feeding detector 101 detects the change of the sheet width. This mixed feeding detector 101 may also determine or detect that the width of the sheet is changed in a plurality of times, for example five times. While the mixed feeding detector 101 and the sheet width detector 102 are illustrated as separate elements in FIGS. 4 and 5, in actual implementation, these devices can be implemented together, and implemented within the controller 103, if desired.

The controller 103 controls the heating width of the fixing member based on the mixed feeding signal and/or the sheet-width signal. The controller 103 is a micro-computer, for example, and controls driving of the stepping motor 23*e*.

The operation of the image forming apparatus 1 of the exemplary embodiment of the present invention will be explained below referring to the flowchart of FIG. 6. According to this example procedure, it is determined during the successive sheet feeding whether or not the fed sheets of the recording medium P have different widths (i.e., whether or not mixed sheet feeding is performed). When mixed feeding is not performed, the width of sheets of the recording medium P is detected, and the heating width is controlled each time. When mixed feeding is performed, the heating width is not changed by a heating-width changing mechanism until an appropriate controlling timing.

Figure 6:
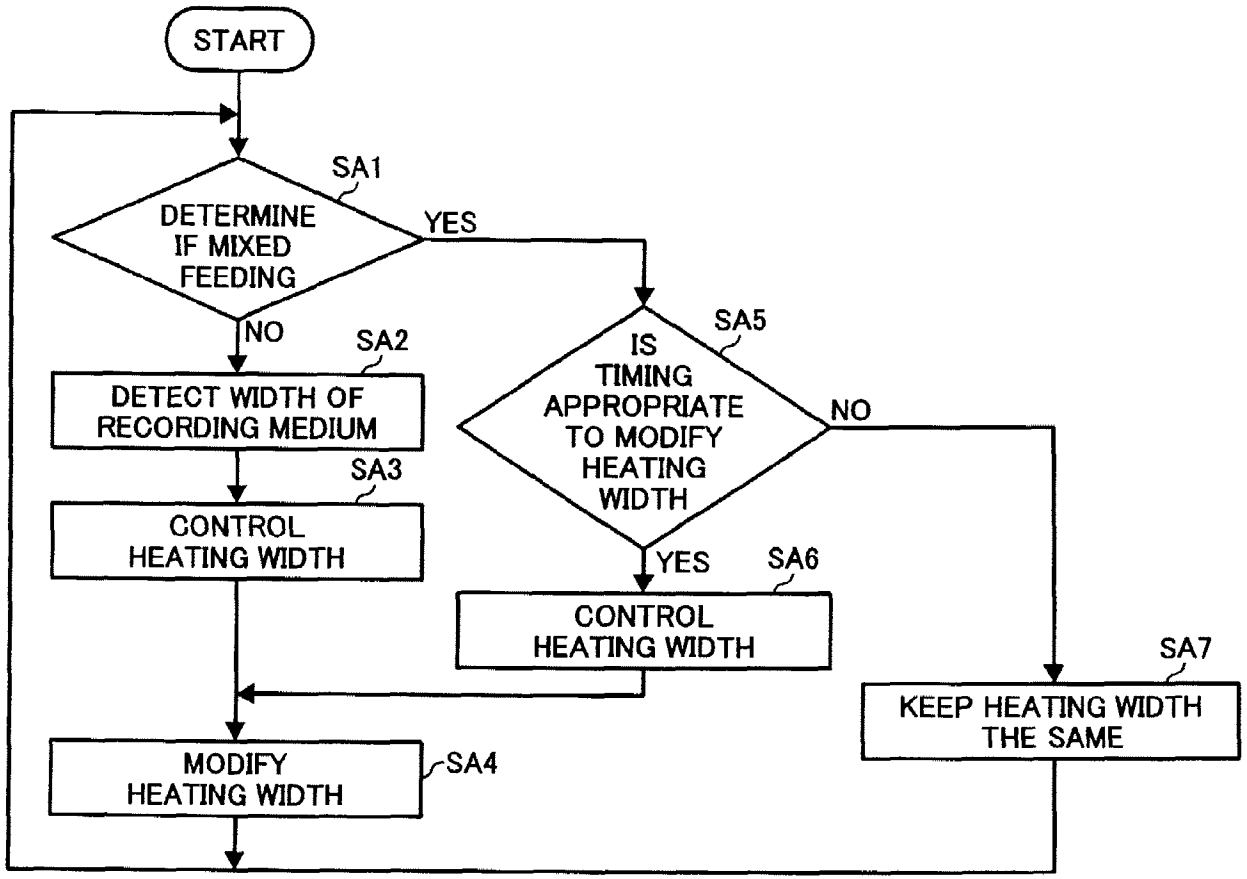
FIG. 6 is a flowchart illustrating an example procedure for controlling the fixing device of FIG. 2.

According to the example procedure of FIG. 6, the mixed sheet feeding detector 101 determines whether or not mixed feeding is performed (Step SA1). When mixed feeding is not performed, the mixed sheet feeding detector 101 does not output a mixed feeding signal, and flow proceeds to step SA2 in which the sheet-width detector 102 detects the width of recording medium P and outputs the sheet-width signal. Next, in step SA3, the controller 103 drives the stepping motor 23*e* according to the sheet-width signal output from the sheet-width detector 102, and changes the position of the shielding members 23*b* to control the heating width which changes the heating width (Step SA4).

In contrast, when the mixed sheet feeding detector 101 detects that mixed feeding is performed, the mixed sheet feeding detector 101 outputs a mixed feeding signal (Yes in Step SA1) and flow proceeds to Step SA5. In step SA5, the controller 103 determines whether or not it is the appropriate controlling timing for changing the heating width. As an example, when it is determined that five or more subsequent recording sheets have a different width, then it would be appropriate to modify the heating width. However, if all sheets being fed were A4 landscape pages, and one A4 portrait page was recorded on, then that may be considered not to be an appropriate situation to modify the heating width. The "appropriate timing" can be based on a sheet count of changed sheets, and according to one embodiment, utilizes five sheets of different width from the previous sheets which were recorded upon, but any number of sheets may be utilized in step SA5, for example 1, 2, 3, 4, 5, . . . 10, etc. When the controller determines that it is the appropriate controlling timing for changing the heating width, the controller 103 controls the heating width (Step SA6). When the controller determines that it is not the timing for changing the heating width, the heating width is not changed (Step SA7). Series of image forming processes are conducted while this example procedure is executed for each sheet of the recording medium P.

When the width of the recording medium P is frequently switched during printing, it may not be feasible or appropriate to change the heating width for each sheet having a different width, and therefore the controller 103 sets an appropriate controlling timing. Thereby, the image forming apparatus 1 can control the heating width more appropriately, resulting in reduction of occurrence of increasing the temperature of a non-sheet feeding portion of the fixing belt.

Figure 7:
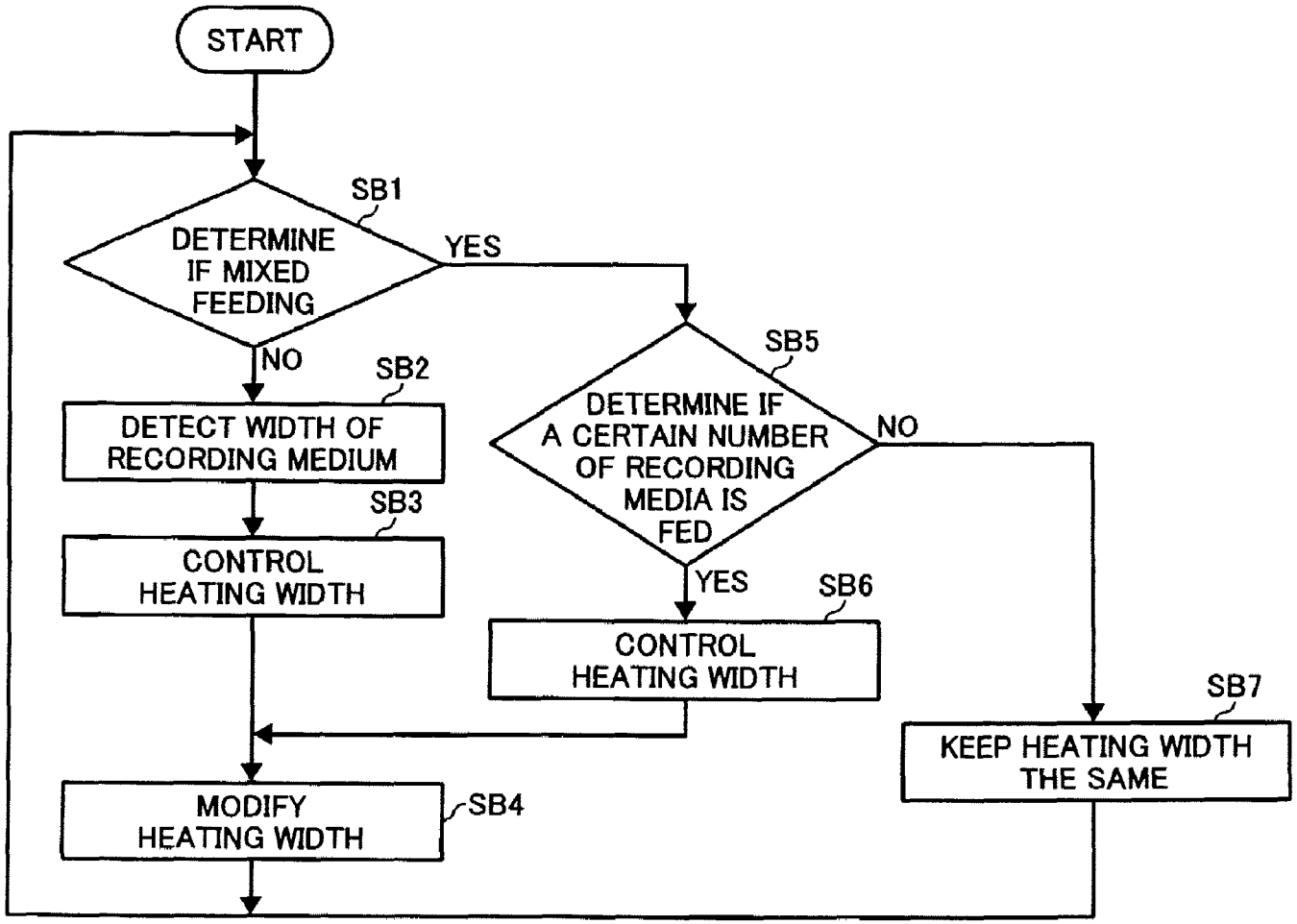
FIG. 7 is a flowchart illustrating another example procedure for controlling the fixing device of FIG. 2.

Referring to the flowchart of FIG. 7, another example procedure for controlling the fixing device 20 of FIG. 2 is explained. The example procedure shown in the flowchart of FIG. 7 is similar to the example procedure of FIG. 6. For example, the processes or functions of steps SB1, SB2, SB3, SB4, SB6, and SB7 of FIG. 7 are similar to those of steps SA1, SA2, SA3, SA4, SA6, and SA7 of FIG. 6, respectively. As shown in FIG. 7, the controller 103 determines whether or not a predetermined number of sheets of the recording medium P are fed (Step SB5). When the predetermined number of sheets of the recording media P are fed, the controller 103 controls the heating width (Step SB6). When the predetermined number of sheets of the recording media P are not fed (for example, the number of sheets of the recording media fed is smaller than the predetermined number), the heating width is not changed (Step SB7). When mixed feeding is not performed, steps SB1, Steps SB2, SB3, and SB4 of FIG. 7 that are similar to steps SA2, SA3, and SA4 of FIG. 6, respectively, are executed.

According to this example procedure, the controller 103 determines whether or not it is the appropriate timing for changing the heating width based on the number of the fed sheets of the recording medium P, which is a specific number, for example, five. Thereby, the image forming apparatus 1 can facilitate the heating width control process.

Figure 8:
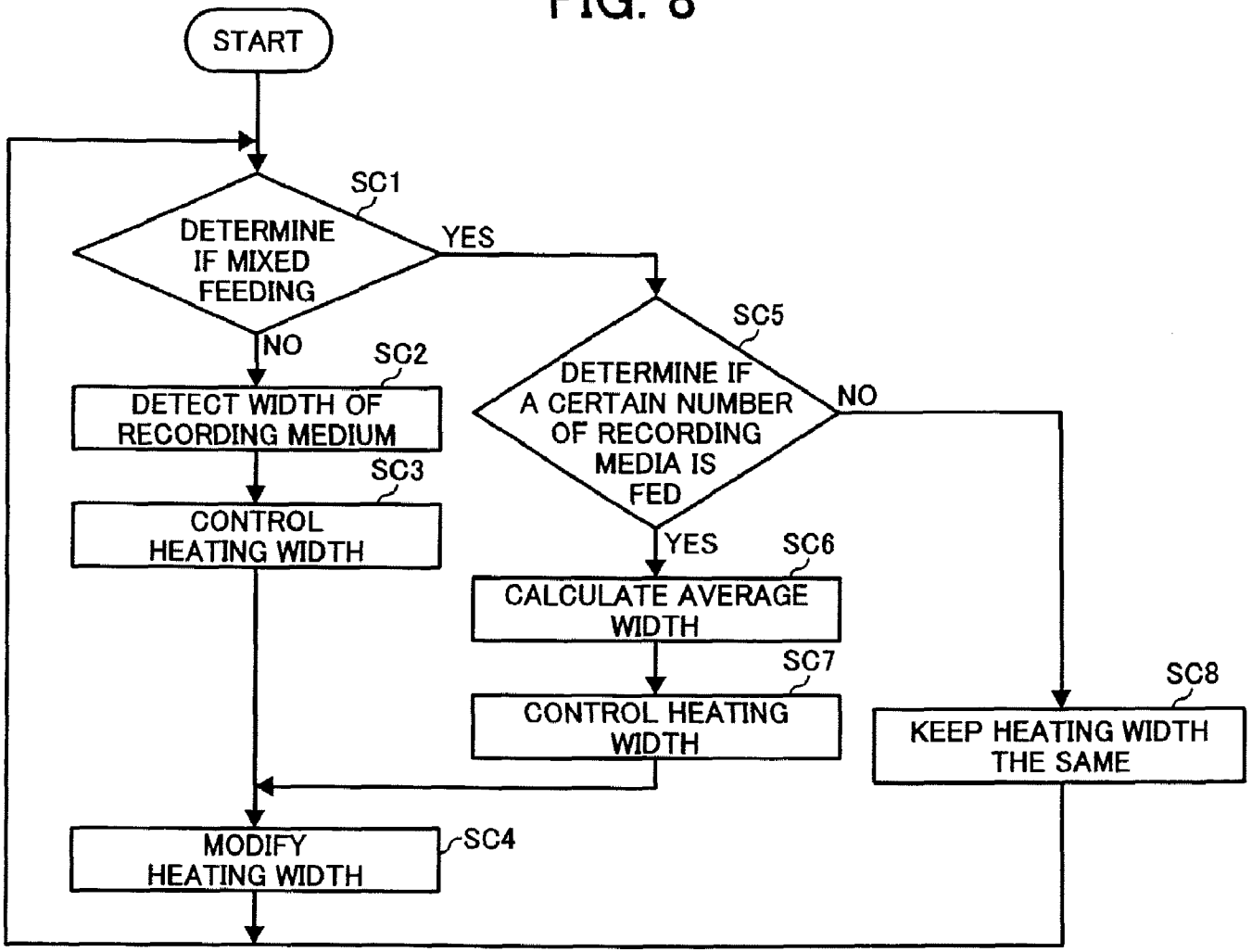
FIG. 8 is a schematic flowchart illustrating yet another example procedure for controlling the fixing device of FIG. 2.

In another example procedure of the control timing of FIG. 8, the heating width is controlled based on the average width of the fed sheets of the recording medium P when mixed feeding is performed. The example procedure shown in the flowchart of FIG. 8 is similar to the example procedure of FIG. 6. For example, the steps or processes of steps SC1, SC2, SC3, and SC4 of FIG. 8 are similar to those of steps SA1, SA2, SA3, and SA4 of FIG. 6, respectively. When a predetermined number of sheets of the recording medium P are fed (Yes in Step SC5), the controller 103 calculates the average width of the fed sheets measured by the sheet-width detector 102 (Step SC6), and controls the heating width (Step SC7) based on the calculated average width. When mixed feeding is not performed, steps SC2, SC3, and SC4 of FIG. 7 that are similar to steps SA2, SA3, and SA4 of FIG. 6, respectively, are executed. When a predetermined number of sheets of the recording medium P are not fed (No in Step SC5), the controller 103 determines it is not the appropriate timing for changing the heating width (Step SC8). According to this example procedure, the controller 103 controls the sheet width based on the calculated average width. Thus, the image forming apparatus 1 controls the appropriate heating width on the basis of the average width of the fed sheets, and thereby occurrence of increasing the temperature in the non-sheet feeding area of the fixing belt and shortage of the heat amount applied to the end portions of the recording medium P can be prevented.

The calculated average width determined in step SA6 may be classified as categories. By using categories, the heating width may be controlled based on the calculated average width. For example, when the calculated average width is 130 mm, the control determines that the A5 size sheet being conveyed in a vertical direction (portrait) is to be printed so as to control the heating width. The following table may be used to correlate the paper width with the paper type:

| | Size (mm) | | | | | | |
|---|---|---|---|---|---|---|---|
| | <100 | 101 < 125 | 126 < 150 | 151 < 175 | 176 < 200 | 201 < 225 | 225< |
| Paper Type | Postcard | Letter-sized (V) | A5 sized (V) | A5 sized (H) | A4 sized (V) | A4 sized (H) | . . . |

In the exemplary embodiments described above, the appropriate timing for changing the heating width in mixed feeding is preferably set to be longer than the time needed for driving the shielding members 23*b* to the target positions by the stepping motor 23*e*. By using this method, the shielding plate can reach the target position when needed, and the control of heating width can be secured.

In the exemplary embodiments described above, the fixing device 20 uses electromagnetic induction heating. However, any other known heater can be used as the heating source.

Figure 9:
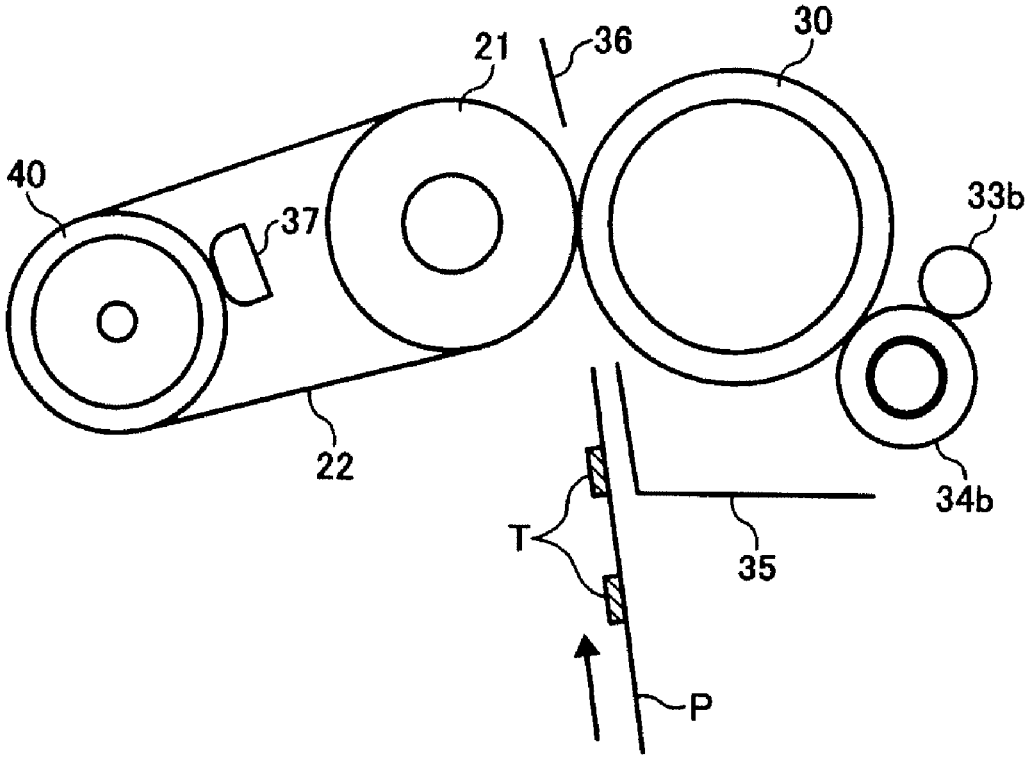
FIG. 9 is a schematic cross section illustrating another fixing device according to an exemplary embodiment of the present invention.

Referring to FIG. 9, another fixing device 20 is illustrated in a schematic cross section. This fixing device 20 includes a heating roller 40, the fixing roller 21, the fixing belt 22, the pressure roller 30, a cleaning roller 33*b*, an oil applying roller 34*b*, the guide plate 35, the separation plate 36, and the thermostat 37. The heating roller 40 includes a plurality of heaters therein that are separated in the axis direction of the heating roller. A description of elements in FIG. 9 which have already been described with respect to FIG. 2 and the other figures is omitted. According to this fixing device 20 of FIG. 9, the control system properly activates one or more of the plural heaters so as to change the heating width. The control system conducts the control processes as shown in FIG. 6, FIG. 7, and FIG. 8.

The present invention includes and can also be implemented according to any of the teachings of JP 2005-258383, which is incorporated herein by reference.

Numerous additional modifications and variations are possible in light of the above teachings. It is therefore to be understood that within the scope of the appended claims, the disclosure of this patent specification may be practiced otherwise than as specifically described herein.

What is claimed is:

1. A fixing device comprising:

a fixing section including at least a fixing member configured to fix a toner image on a recording medium upon application of heat thereto;

a sheet-width detector configured to detect a width of the recording medium and output a sheet-width signal;

a heating-width changing mechanism configured to change a heating width of the fixing member;

a mixed feeding detector configured to detect whether mixed feeding of a plurality of sheets of the recording medium having different widths is performed during a successive sheet feeding, and output a mixed feeding signal; and a controller configured to control the heating-width changing mechanism to control the heating width based on the sheet-width signal and the mixed feeding signal, wherein the controller calculates an average width of a predetermined number of sheets of the recording medium to change the heating width based on the calculated average width.

2. The fixing device of claim 1, wherein the controller causes the heating-width changing mechanism to change the heating width when the width of the recording medium is changed without receiving the mixed feeding signal, and the controller causes the heating-width changing mechanism not to change the heating width until a predetermined timing when the sheet width of the recording medium is changed while receiving the mixed feeding signal.

3. The fixing device of claim 1, wherein the fixing section further includes:

a fixing member configured to fix the toner image on the recording medium;

a coil extending in a width direction of the fixing member and opposed to the fixing member;

a core disposed so as to be opposed to the coil; and a shielding member configured to cover at least a portion of the core to control electromagnetic induction caused by flowing an electric current to the coil, and wherein the shielding member is moved to change the heating width.

4. The fixing device of claim 3, wherein the fixing section further includes a stepping motor, and wherein the shielding member is moved by the stepping motor.

5. The fixing device of claim 3, wherein when the mixed feeding signal is detected, a predetermined timing is set to be longer than a time needed for moving the shielding member to a target position.

6. An image forming apparatus comprising:

an image bearing member configured to bear a toner image thereon;

a transfer device configured to transfer the toner image onto a recording medium; and the fixing device of claim 1.

7. A fixing device comprising:

a fixing section including at least a fixing member configured to fix a toner image on a recording medium upon application of heat thereto;

means for detecting a width of the recording medium and outputting a sheet-width signal;

a heating-width changing mechanism configured to change a heating width of the fixing member;

means for detecting whether mixed feeding of a plurality of sheets of the recording medium having different widths is performed during a successive sheet feeding, and outputting a mixed feeding signal; and a control means for controlling the heating-width changing mechanism to control the heating width based on the sheet-width signal and the mixed feeding signal, wherein the control means calculates an average width of a predetermined number of sheets of the recording medium to change the heating width based on the calculated average width.

8. The fixing device of claim 7, wherein the control means causes the heating-width changing mechanism to change the heating width when the width of the recording medium is changed without receiving the mixed feeding signal, and the control means causes the heating-width changing mechanism not to change the heating width until a predetermined timing when the sheet width of the recording medium is changed while receiving the mixed feeding signal.

9. The fixing device of claim 7, wherein the fixing section further includes:

a fixing member configured to fix the toner image on the recording medium;

a coil extending in a width direction of the fixing member and opposed to the fixing member;

a core disposed so as to be opposed to the coil; and a shielding member configured to cover at least a portion of the core to control electromagnetic induction caused by flowing an electric current to the coil, and wherein the shielding member is moved to change the heating width.

10. The fixing device of claim 9, wherein the fixing section further includes a stepping motor, and wherein the shielding member is moved by the stepping motor.

11. The fixing device of claim 10, wherein when the mixed feeding signal is detected, the predetermined timing is set to be longer than a time needed for moving the shielding member to a target position.

* * * * *